US011594153B2

(12) United States Patent
Rathore et al.

(10) Patent No.: US 11,594,153 B2
(45) Date of Patent: Feb. 28, 2023

(54) SEAL ASSEMBLY FOR UTILITY METER AND ASSOCIATED METHODS

(71) Applicant: Landis+Gyr Innovations, Inc., Alpharetta, GA (US)

(72) Inventors: Bahadur Singh Rathore, Noida (IN); Sitaram Sunda, Jaipur (IN)

(73) Assignee: LANDIS+GYR INNOVATIONS, INC., Alpharetta, GA (US)

( * ) Notice: Subject to any disclaimer, the term of this patent is extended or adjusted under 35 U.S.C. 154(b) by 1074 days.

(21) Appl. No.: 16/318,382

(22) PCT Filed: Jul. 22, 2016

(86) PCT No.: PCT/US2016/043612

§ 371 (c)(1),
(2) Date: Jan. 17, 2019

(87) PCT Pub. No.: WO2018/017126

PCT Pub. Date: Jan. 25, 2018

(65) Prior Publication Data

US 2019/0259308 A1 Aug. 22, 2019

(51) Int. Cl.
*E05B 65/00* (2006.01)
*G09F 3/14* (2006.01)

(52) U.S. Cl.
CPC ..... *G09F 3/14* (2013.01); *E05B 65/0089* (2013.01)

(58) Field of Classification Search
CPC .. E05B 65/0089; E05B 39/02; E05B 47/0004; E05B 39/00; Y10S 292/38; G09F 3/00; G09F 3/03; G09F 3/08; G09F 3/0335; G09F 3/14; Y10T 70/485; Y10T 292/48; B65D 55/026
USPC ..... 292/308–327, 307 b, 307 r
See application file for complete search history.

(56) References Cited

U.S. PATENT DOCUMENTS 3,591,223 A * 7/1971 Castro Neto ..... G09F 3/0311 292/320
5,782,513 A 7/1998 Nazzari
5,788,294 A * 8/1998 Leon ..... G09F 3/0358 292/307 R
6,082,789 A * 7/2000 Wenk ..... G09F 3/0358 292/320

(Continued)

FOREIGN PATENT DOCUMENTS

CN 101369390 A * 2/2009 ..... B65D 77/185
CN 101369390 5/2010

(Continued)

OTHER PUBLICATIONS

International Application No. PCT/US2016/043612, International Search Report and Written Opinion dated Nov. 15, 2016, 11 pages.

(Continued)

*Primary Examiner* — Kristina R Fulton
*Assistant Examiner* — Emily G. Brown
(74) *Attorney, Agent, or Firm* — Kilpatrick Townsend & Stockton LLP

(57) ABSTRACT

Disclosed is a seal assembly for a utility meter enclosure. The seal assembly secures together a front cover and a base of the utility meter enclosure in a way that requires breaking of the seal assembly in order to open the utility meter enclosure. As such, the seal assembly provides an indication if the utility meter enclosure has been opened or tampered with.

19 Claims, 11 Drawing Sheets

(56) References Cited

U.S. PATENT DOCUMENTS

| | | | | |
|---|---|---|---|---|
| 6,283,517 | B1 * | 9/2001 | Nazzari | G09F 3/037 292/322 |
| 6,481,765 | B1 * | 11/2002 | Jelavic | G09F 3/0311 292/307 R |
| 8,733,805 | B2 * | 5/2014 | Nazzari | G09F 3/0352 292/307 R |
| 8,872,506 | B2 * | 10/2014 | Walser | G01R 11/04 324/156 |
| 2014/0265369 | A1 * | 9/2014 | Gryczynski | G09F 3/0358 292/320 |

FOREIGN PATENT DOCUMENTS

| | | | | |
|---|---|---|---|---|
| CN | 204288694 | | 4/2015 | |
| GB | 1400760 | A * | 7/1975 | B65D 77/185 |
| GB | 2126957 | | 4/1984 | |
| RU | 56039 | U1 * | 9/2005 | B65D 77/185 |
| WO | 2005086121 | | 9/2005 | |
| WO | WO-2011147449 | A1 * | 12/2011 | F16G 11/04 |

OTHER PUBLICATIONS

Indian Application No. 201917001455, First Examination Report dated Dec. 16, 2021, 6 pages.
Mexican Application No. MX/A/2019/000728, Office Action dated Aug. 18, 2022, 11 pages (6 pages English summary, 5 pages original document).

* cited by examiner

SEAL ASSEMBLY FOR UTILITY METER AND ASSOCIATED METHODS

RELATED FIELDS

A seal assembly for a utility meter and associated methods.

BACKGROUND

The usage of resources such as gas, electricity and water are typically measured using utility meters. Some utility meters include plastic seals that serve as tamper evident seals. Current seals involve insert molding a stainless steel wire. The complexity of manufacturing the current seals results in reduced production capacity and increased costs.

SUMMARY

The term embodiment and like terms are intended to refer broadly to all of the subject matter of this disclosure. Statements containing these terms should be understood not to limit the subject matter described herein. This summary is a high-level overview of various aspects of the disclosure and introduces some of the concepts that are further described in the Detailed Description section below. This summary is not intended to identify key or essential features, nor is it intended to be used in isolation.

Disclosed is a seal assembly for a utility meter and associated methods. Instead of insert molding a stainless steel wire, the wire is assembled with the seal assembly and the utility meter after molding to provide a tamper indication feature.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
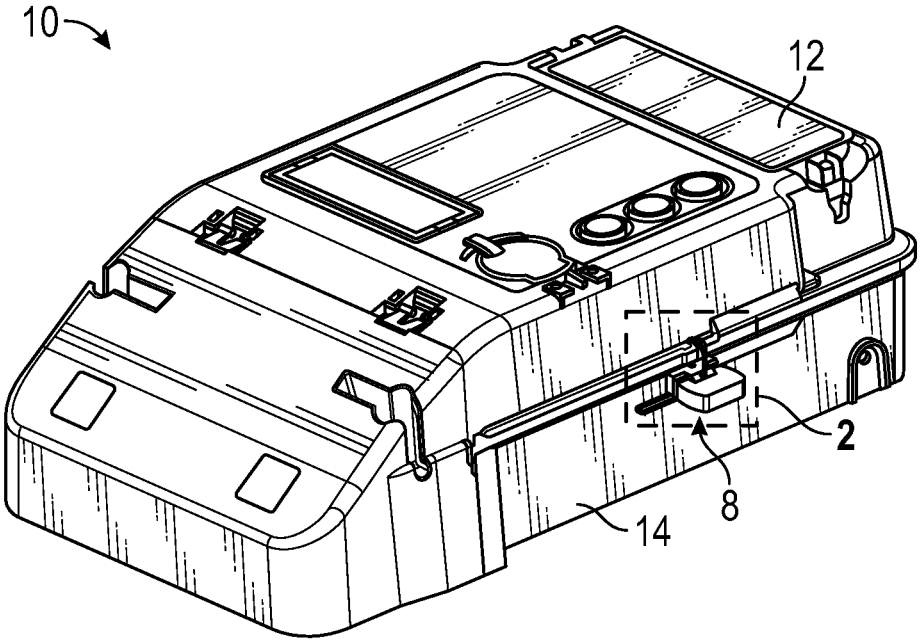
FIG. 1 is a perspective view of a seal assembly assembled with a utility meter.
Figure 2:
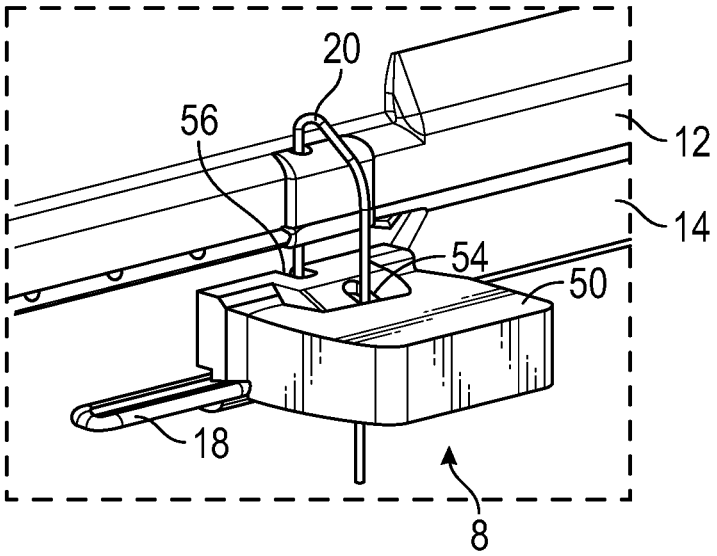
FIG. 2 is a close-up view of inset circle 2 of FIG. 1.
Figure 3:
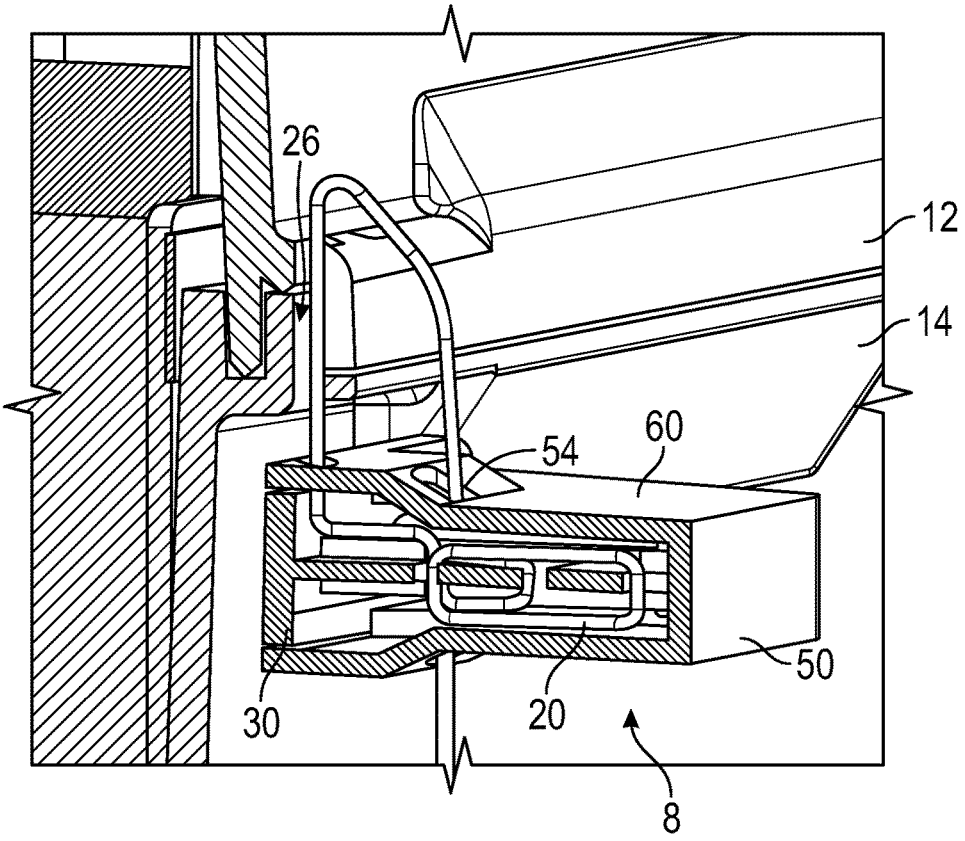
FIG. 3 is a partial cross-sectional view of the seal assembly and utility meter assembly of FIG. 1.

Disclosed is a seal assembly 8 for use with a utility meter enclosure, such as enclosure 10 having a front cover 12 and a base 14. As shown in FIGS. 2-3, the seal assembly 8 includes a wire 20 that interfaces with a male component 30 and a female component 50. Wire 20 can be a stainless steel wire or wire made of any other suitable material. As described in more detail below, the wire 20 is wrapped around the male component 30 and the female component 50 and inserted through an opening 26 that extends through the front cover 12 and the base 14 to secure the seal assembly 8 with the utility meter enclosure 10. In particular, the wire is secured with the male component 30, the opening 26 and the female component 50 such that the seal assembly 8 must be broken for the front cover 12 to be separated from the base 14. In this way, the seal assembly 8 serves as a tamper indictor.

Figure 4:
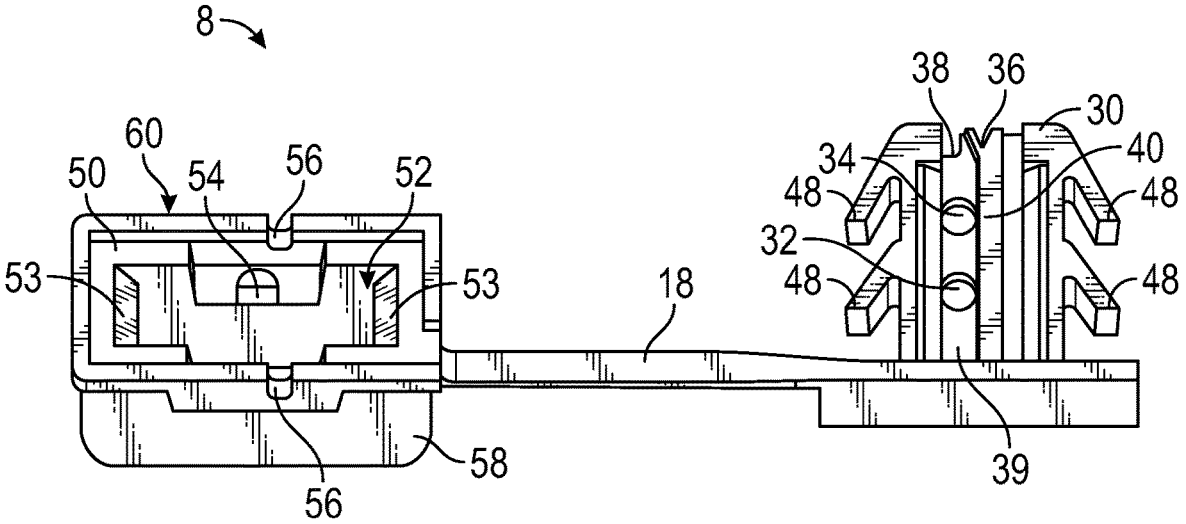
FIG. 4 is a perspective view of a female part and a male part of the seal assembly of FIG. 1 joined together by a rib according to an example.
Figure 5:
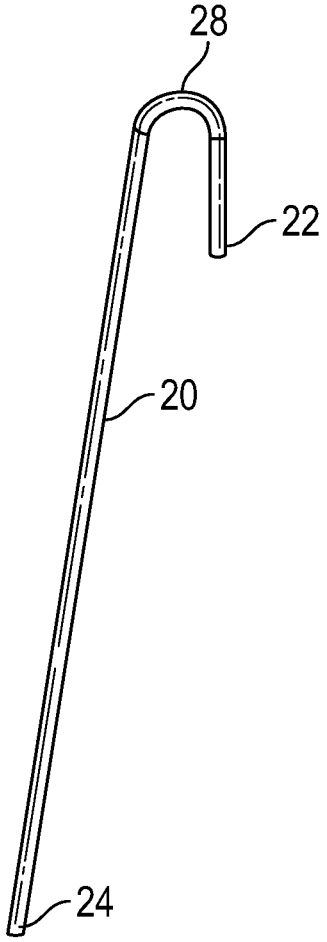
FIG. 5 is a perspective view of a stainless steel wire of the seal assembly of FIG. 1.

FIG. 4 is a perspective view of the male component 30 and the female component 50 of the seal assembly 8, while FIG. 5 is a perspective view of the wire 20 of the seal assembly 8 in isolation. The male component 30 is joined with the female component 50 by a flexible rib 18. In some non-limiting examples, the male component 30 and the female component 50 are made of any suitable plastic and are formed by a molding process such as, but not limited to, injection molding.

As illustrated, male component 30 includes a plurality of self-locking anchors 48, a top side 42 (FIG. 6) opposite a bottom side 44 (FIG. 7) and two apertures 32, 34 that generally extend from the top side 42 to the bottom side 44. The top side 42 includes a first recessed channel 39 adjacent a second recessed channel 40 while the bottom side 42 includes a third recessed channel 43 adjacent a fourth recessed channel 45. In some cases, any or all of channels 39, 40, 43 and 45 are not recessed. A U-shaped groove 38 extends between an end of the first recessed channel 39 of the top side 42 and an end of the third recessed channel 43 of the bottom side 44. A V-shaped groove 36 extends between an end of the second recessed channel 40 of the top side 42 and an end of the fourth recessed channel 45 of the bottom side 44.

With reference to FIG. 4, female component 50 includes a cavity 52 shaped and sized to receive the male component 30. The cavity 52 includes a plurality of undercuts 53 that lock the self-locking anchors 48 of the male component 30 when the male component is received within the cavity 52. Female component 50 also includes two body openings 54 that are opposite one another and formed within first and second faces 58, 60, respectively, and two U-shaped openings 56 opposite one another and formed within the first and second faces 58, 60, respectively.

Figure 6:
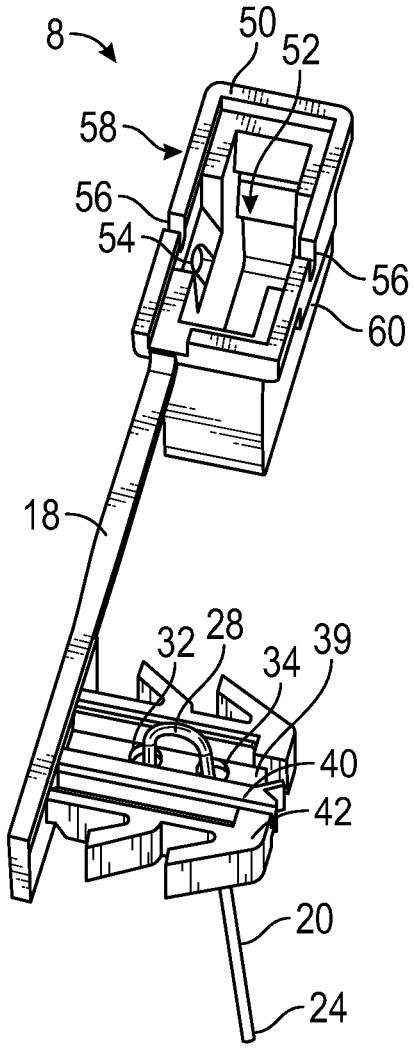
FIG. 6 illustrates a first step in an exemplary method of assembling the seal assembly of FIG. 1.
Figure 7:
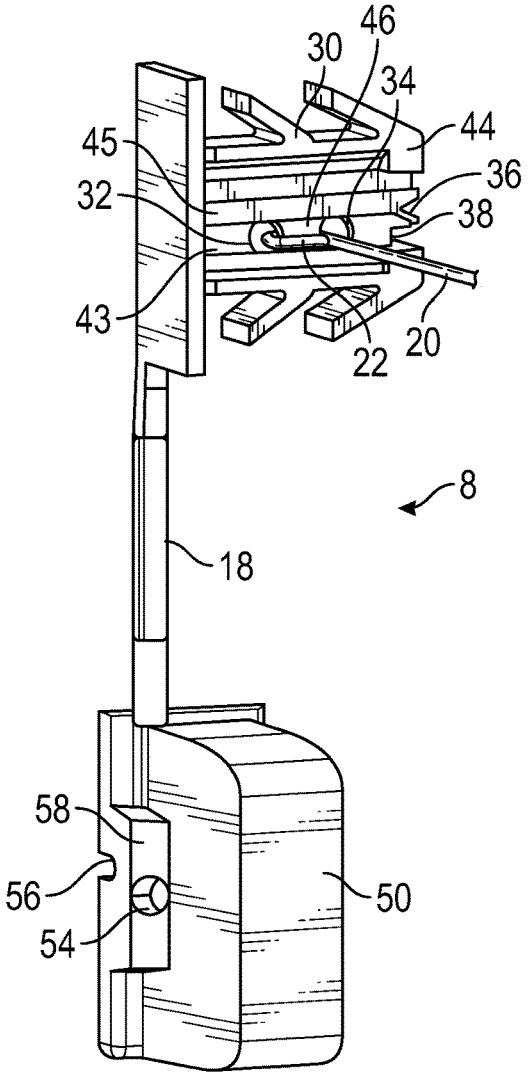
FIG. 7 illustrates a second step in an exemplary method of assembling the seal assembly of FIG. 1.

According to one exemplary sealing method illustrated in FIGS. 5-10, the first end 22 of the wire 20 can be bent to create a bend 28 (FIG. 5). As shown in FIG. 6, the first end 22 of the wire 20 can be inserted into the first aperture 32 of the male component 30 and the second end 24 of the wire 20 can be inserted into the second aperture 34 of the male component 30 such that the bend 28 is adjacent the first recessed channel 39 of the top side 40. Next, as shown in FIG. 7, the first end 22 of the wire 20 is bent so a portion distal of the bend 28 is positioned adjacent a segment 46 of the third recessed channel 43 of the bottom side 44, where the segment 46 is between the first and second apertures 32, 34.

Figure 8:
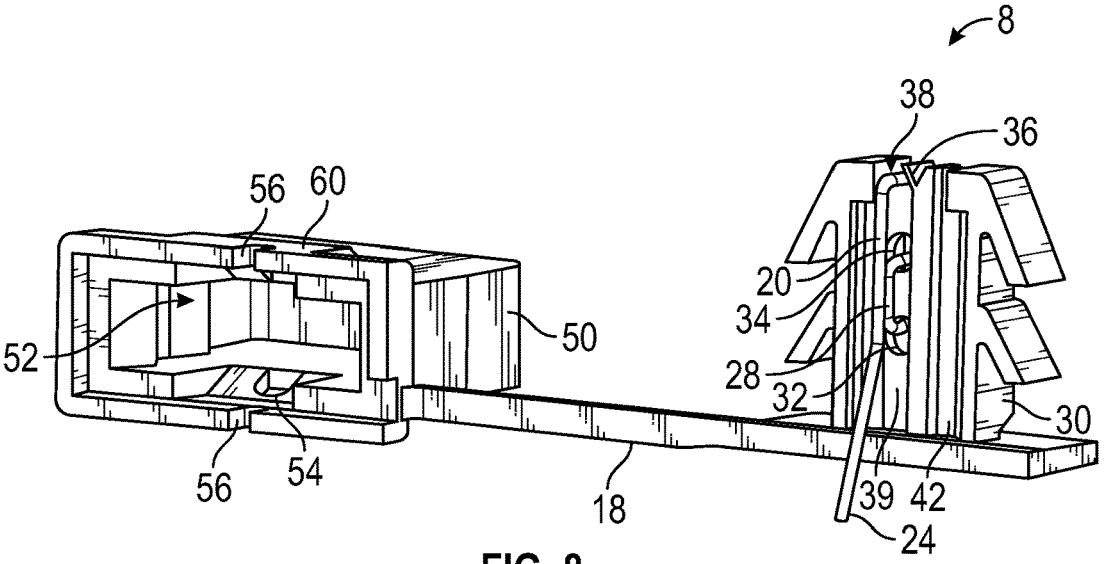
FIG. 8 illustrates a third step in an exemplary method of assembling the seal of FIG. 1.
Figure 9:
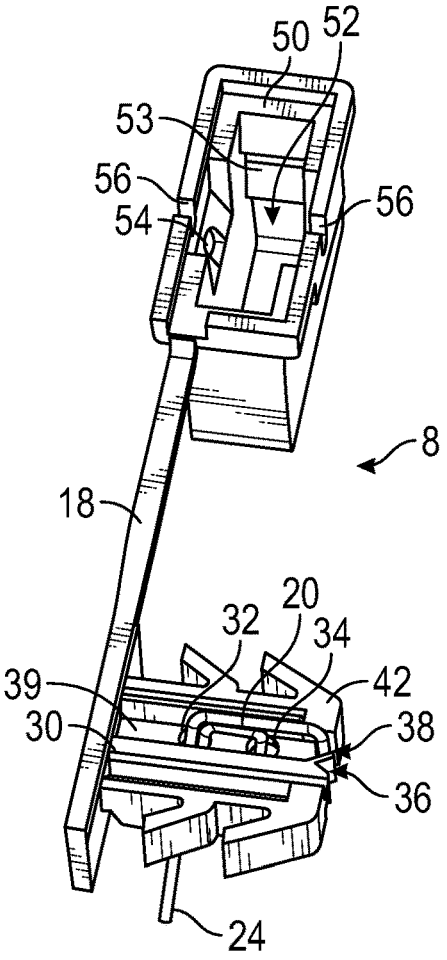
FIG. 9 illustrates a fourth step in an exemplary method of assembling the seal assembly of FIG. 1.
Figure 10:
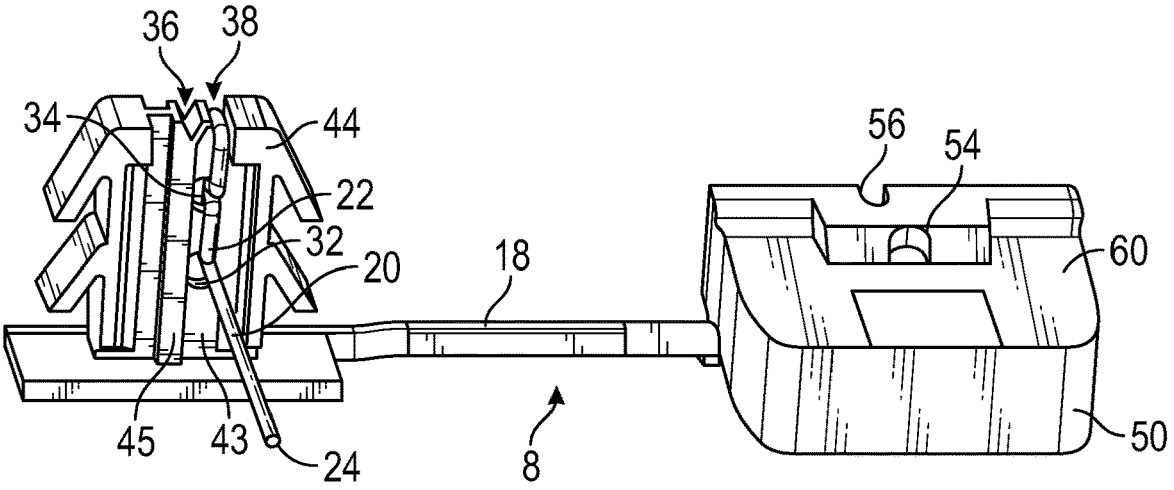
FIG. 10 illustrates a fifth step in an exemplary method of assembling the seal assembly of FIG. 1.
Figure 11:
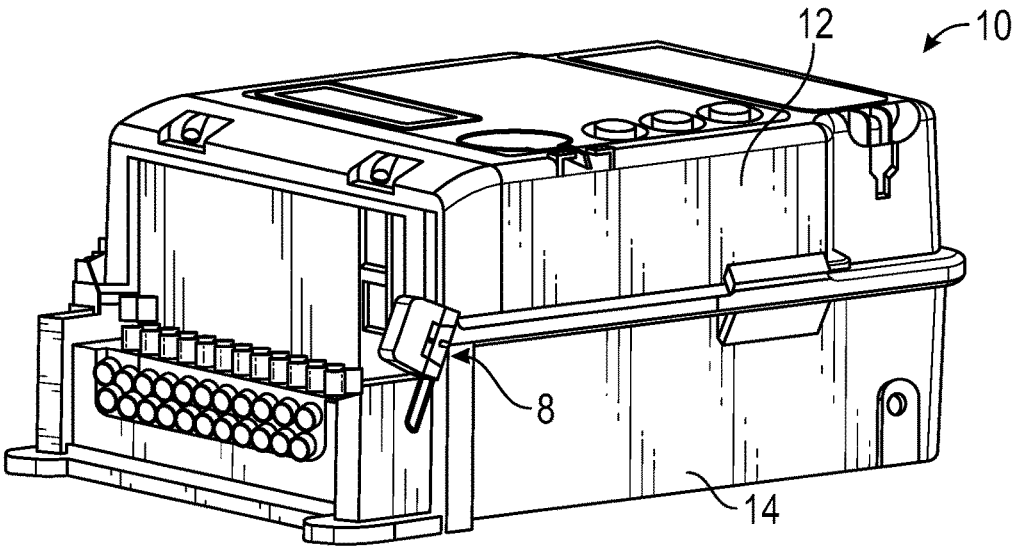
FIG. 11 is a perspective view of the seal assembly of FIG. 1 assembled with another utility meter.
Figure 12:
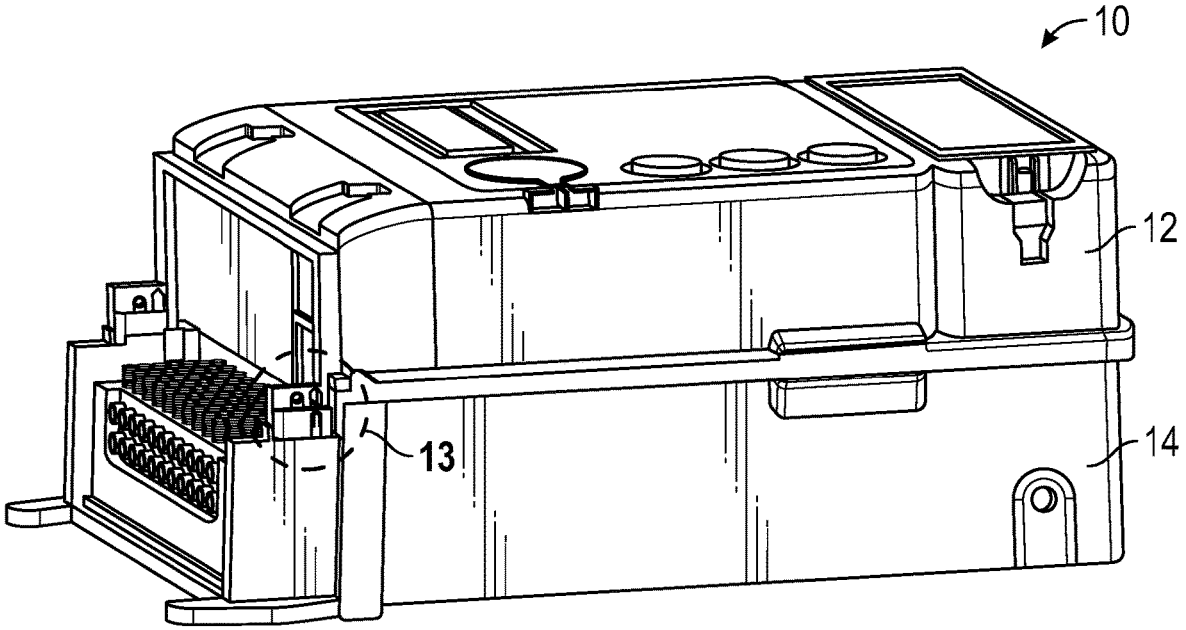
FIG. 12 is a perspective view of the utility meter of FIG. 11, shown without the seal assembly.
Figure 13:
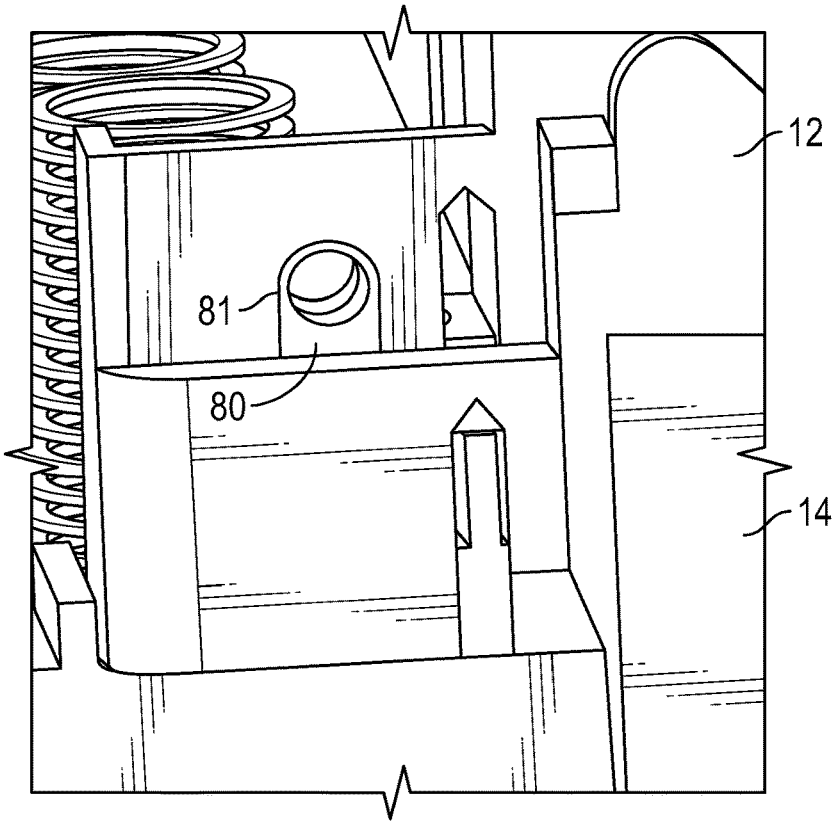
FIG. 13 is a close-up view of inset circle 13 of FIG. 12.
Figure 14:
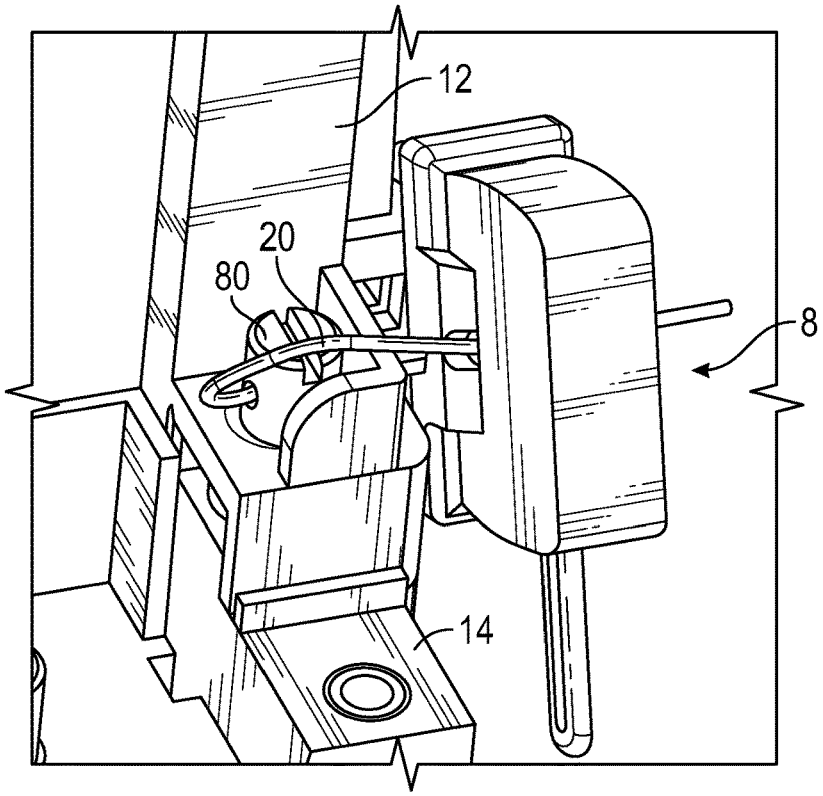
FIG. 14 is a partial close-up view of the seal assembly and utility meter assembly of FIG. 11.
Figure 15:
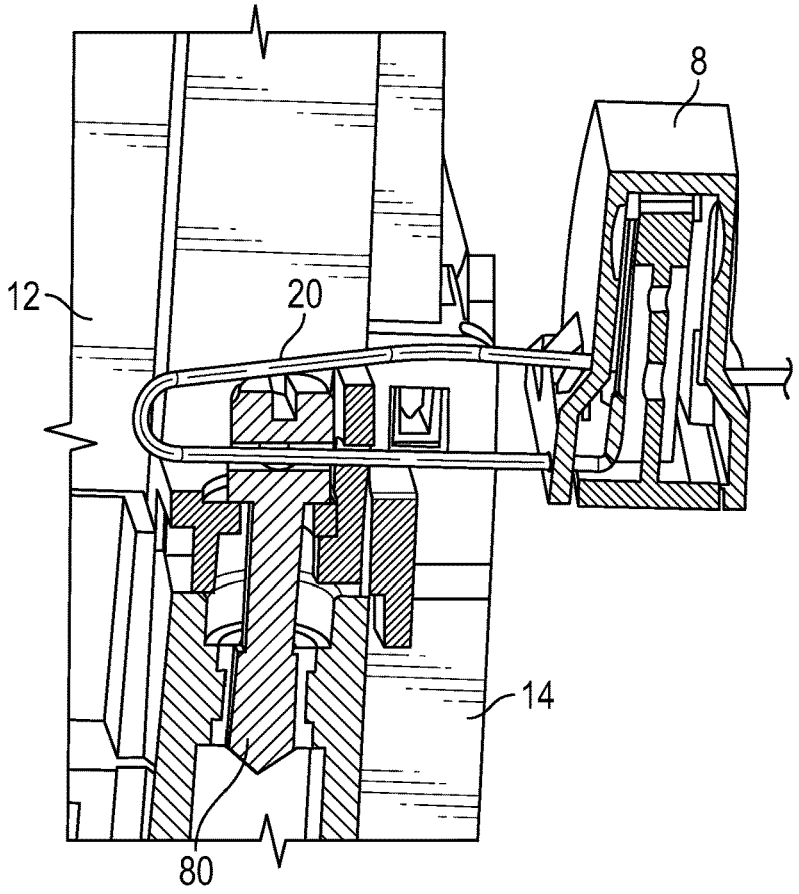
FIG. 15 is a cross-sectional view of the seal assembly and utility meter assembly of FIG. 11.
Figure 16:
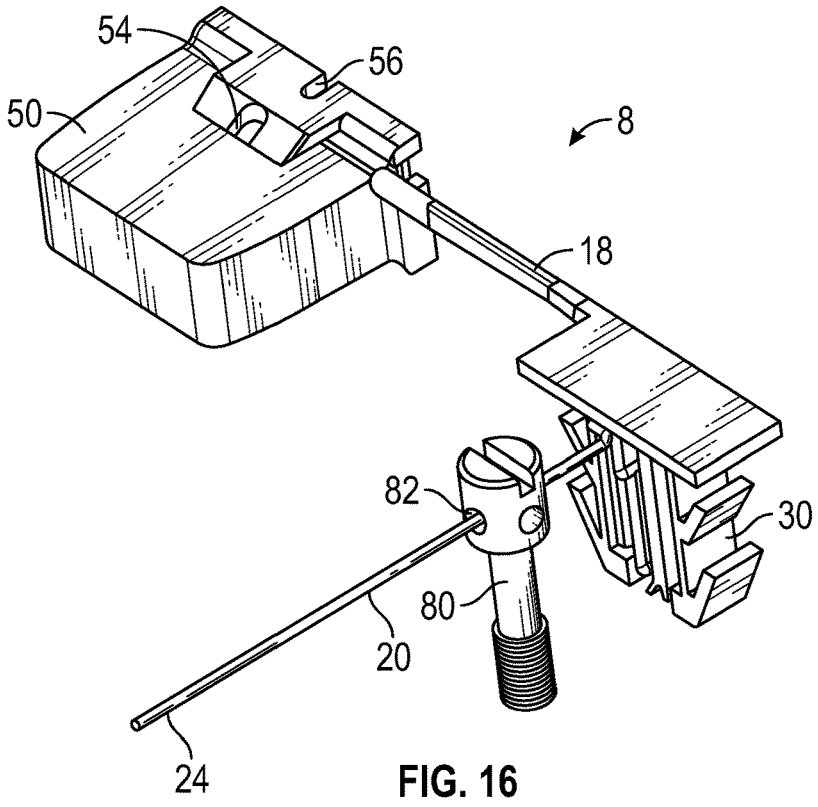
FIG. 16 illustrates the seal assembly of FIG. 11 assembled with a sealing screw for use with the utility meter of FIG. 11.

As a next step in the illustrated exemplary method, shown in FIG. 8, the second end 24 of wire 20 wraps from the bottom side 44 of the male component 30 around the U-shaped groove 38 until it is received within the first recessed channel 39 of the top side 42 of the male component 30. As shown in FIG. 8, the second end 24 of the wire 20 overlies the bend 28 of the wire 20. FIG. 9 illustrates the subsequent insertion of the second end 24 of the wire 20 through the first aperture 32 so that the second end 24 projects from the bottom side 44 of the male component 30, as shown in FIG. 10.

Figure 17:
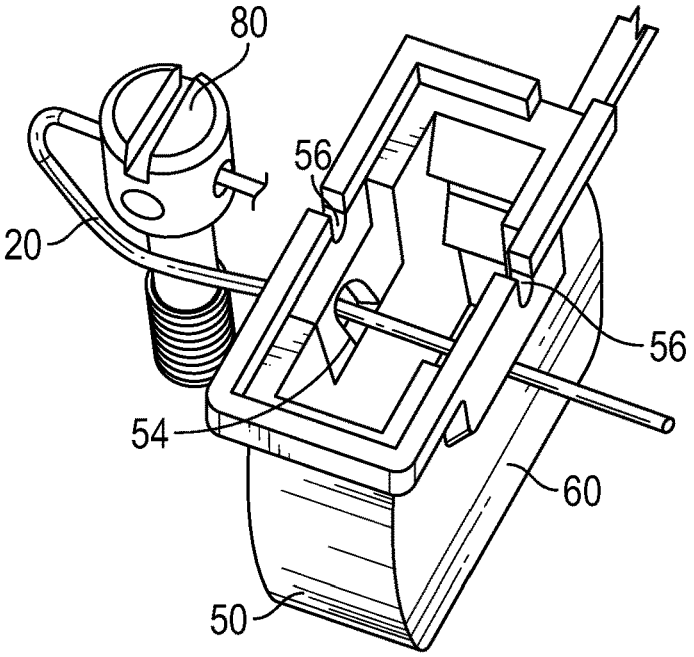
FIG. 17 is a perspective top view illustrating a portion of the wire, the sealing screw, and the female component of FIG. 16, shown without the male component for simplicity.

In some examples, the seal assembly 8 is next assembled with the utility meter enclosure 10. In particular, the second end 24 of the wire 20 extending from the bottom side 44 of the male component 30 is then inserted through the opening 26 extending through the front cover 12 and the base 14 (see FIGS. 2-3) to secure the seal assembly 8 with the utility meter enclosure 10. Then, as shown for example in FIG. 17, the wire 20 is fed through both of the body openings 54 of the female component 50. FIG. 17 illustrates the seal assembly 8 without the male component 30 for ease of illustration. Next, the male component 30 of the seal assembly 8 is inserted into the cavity 52 of the female component 50 and the two components are press fit together as shown in FIG. 3 and FIG. 18-20.

Figure 22:
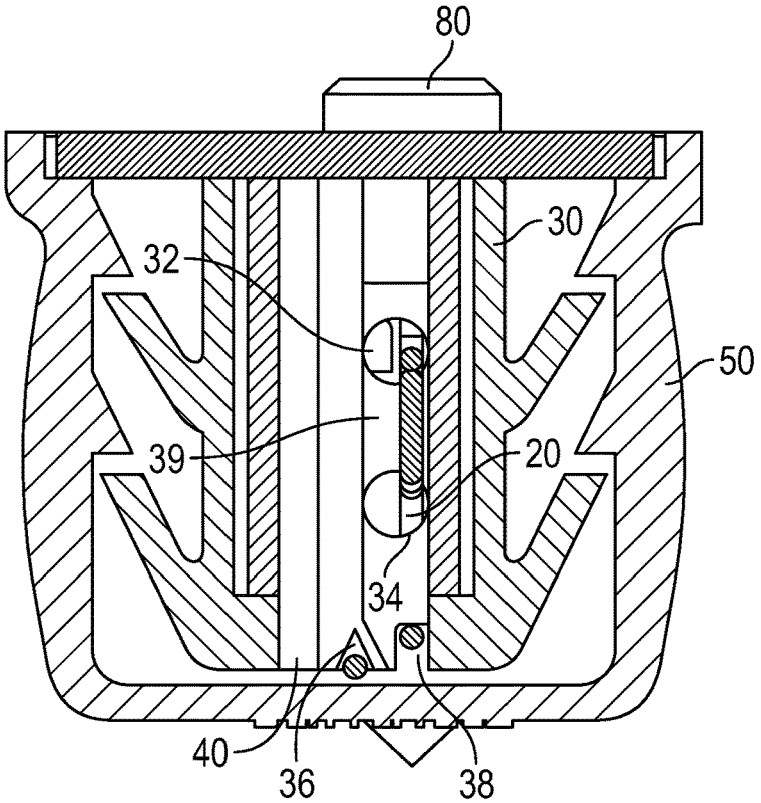
FIG. 22 is a section view of the seal assembly of FIG. 19, taken along line 22-22.

When the male component 30 is positioned within the female component 50, the two body openings 54 of the female component 50 are configured to align with the V-shaped groove 36 of the male component 30 such that, as the male component 30 clamps down on the wire 20, the V-shaped groove 36 of the male component 30 provides pressure and retains the wire 20 in position against a surface of the cavity 52 of the female component 50, as shown in FIGS. 18-20 and 22. In some cases, the two body openings 54 generally align with the second recessed channel 40 of the top side 42 of the male component 30 and the fourth recessed channel 45 of the bottom side 44 of the male component 30, respectively. When the male component 30 is press fit with the female component 50, the wire 20 is sandwiched in the V-shaped groove 36 as shown in FIG. 22 against the surface of the cavity 52 of the female component 50.

Figure 18:
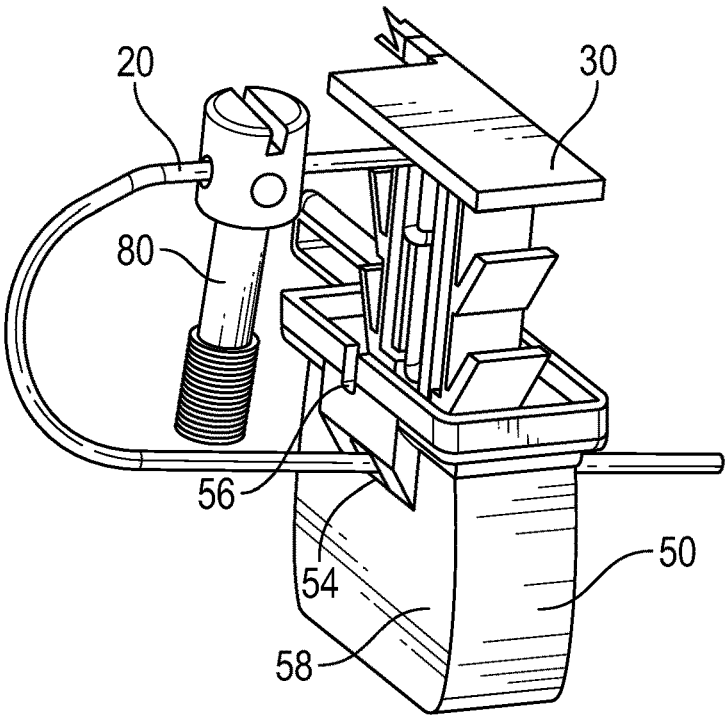
FIG. 18 is a perspective first side view of the seal assembly of FIG. 16 as the male component is inserted into the female component.
Figure 19:
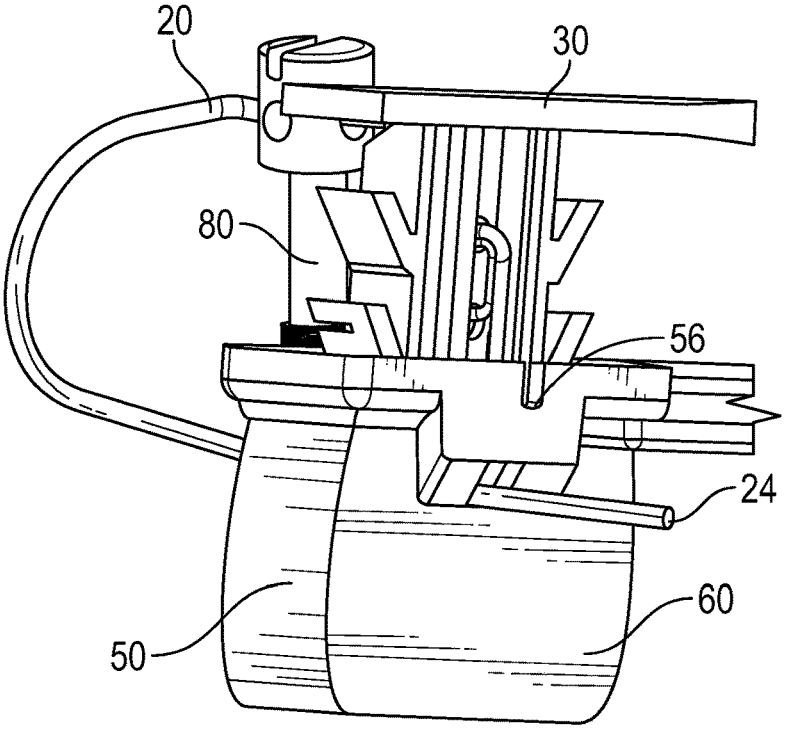
FIG. 19 is a perspective second side view of the seal assembly of FIG. 16 as the male component is inserted into the female component.
Figure 20:
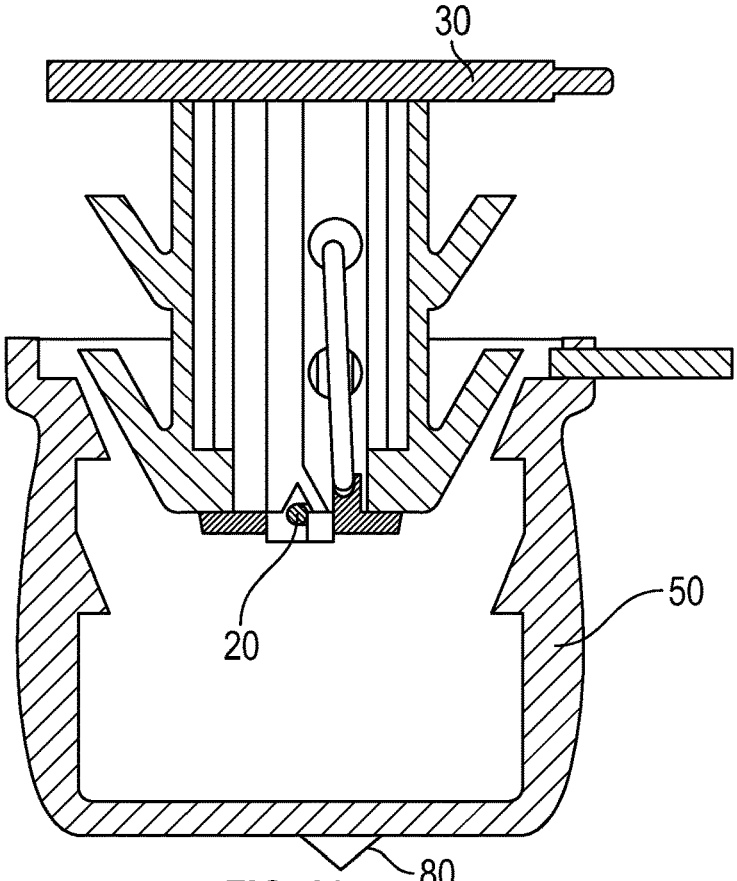
FIG. 20 is a section view of the seal assembly of FIG. 11 as the male component is inserted into the female component.
Figure 21:
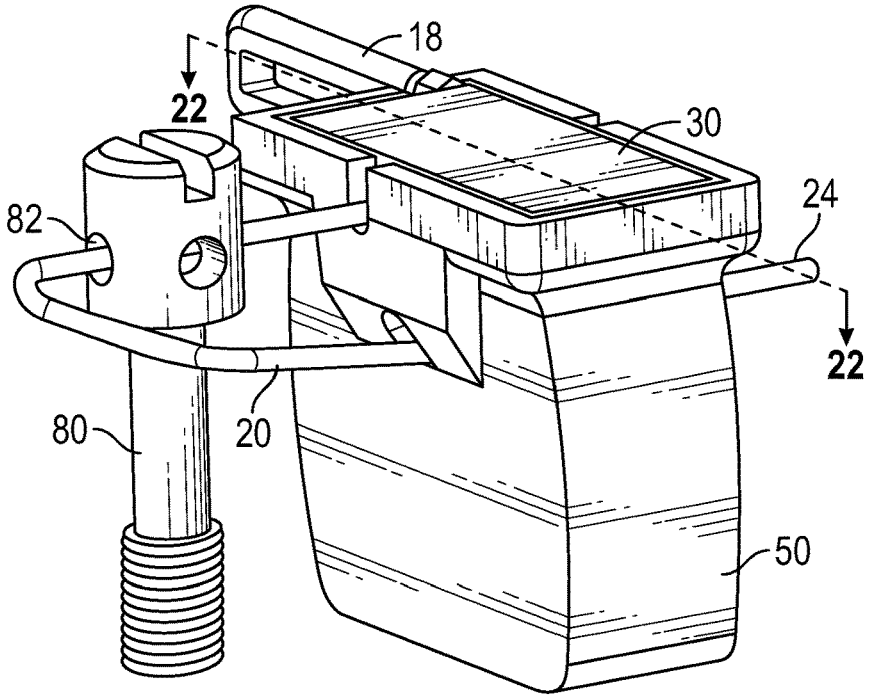
FIG. 21 illustrates the seal assembly assembled with the sealing screw of FIG. 16, shown with the male component inserted into the female component.

After the male component 30 is press fit with the female component 50, the portion of the wire 20 exiting the body opening 54 of second face 60 of the female component 50 can be positioned within the U-shaped opening 56 of the second face 60 of the female component 50. As shown in FIG. 18, the other end of the wire 20 (extending between the screw 80 and the male component 30) is configured to rest within the U-shaped opening 56 of first face 58 of the female component 50 when the male component 30 is inserted into the female component 50. As described above, the seal assembly 8 cannot be removed from utility meter enclosure 10 without breaking one or both the female and male components and/or cutting the wire 20, which would provide an indication of tampering.

In some cases, as illustrated in FIGS. 11-22, the seal assembly 8 can be used with a utility meter enclosure 10 that receives a screw 80 to secure the front cover 12 with the base 14. The seal assembly 8 can be assembled as described above, except that instead of being received within an opening 26 extending through the front cover 12 and the base 14, the second end 24 of the wire 20 is received through an opening 81 (FIG. 13) in one of the front cover 12 or the base 14 and then through opening 82 that extends through a screw 80 that joins the front cover 12 with the base 14, as illustrated in FIGS. 14-19.

Once the male component 30 has been press fit with the female component 50 and the wire 20 has been arranged as described herein, the seal assembly 8 cannot be opened without breaking one or both of the male or female components and/or cutting the wire. In this way, the seal assembly 8 provides a visual indication when the utility meter enclosure 10 has been tampered with and/or opened.

Although only one exemplary method for assembling the wire 20 with the male component 30 and the female component 50 and utility meter enclosure 10 has been described, numerous variations are possible so long as the wire 20 is retained within the seal assembly 8 and cannot be backed out after the male component 30 is assembled with the female component 50.

Since the wire 20 is inserted after molding instead of during an insert molding procedure, the molding production capacity increases and the capital and operational costs are reduced while still maintaining the security requirements of the seal assembly 8.

Numerous modifications of this invention may be made in the composition, application, manufacturing process and other aspects of this invention without departing from the objectives and spirit of the description above and in the Figures.

The invention claimed is:

1. A seal assembly for a utility meter enclosure, the seal comprising:

a female component joined with a male component by a flexible rib; and a stainless steel wire, wherein:

the female component comprises a cavity sized and dimensioned to receive the male component;

the male component comprises a top side and a bottom side opposite the top side, wherein the top side comprises a first channel and a second channel and the bottom side comprises a third channel and a fourth channel, wherein a U-shaped groove extends between an end of the first channel and an end of the third channel, wherein a V-shaped groove extends between an end of the second channel and an end of the fourth channel, and wherein two apertures extend between the top side and the bottom side;

the female component further comprises two body openings, and wherein, when the male component is received in the cavity of the female component, a first body opening of the two body openings aligns with the second channel of the male component and a second body of the two body openings aligns with the fourth channel of the male component; and the female component further comprises two U-Shaped openings, each U-shaped opening configured to receive a portion of the stainless steel wire, wherein a first U-shaped opening of the two U-shaped openings aligns with the first channel of the male component when the male component is received in the cavity of the female component.

2. The seal assembly of claim 1, wherein a first end of the stainless steel wire is inserted through a first aperture of the two apertures, wherein a second end of the stainless steel wire is inserted through a second aperture of the two apertures, and wherein the second end of the stainless steel wire is received in the U-shaped groove, extends along the first channel, and is also inserted through the first aperture of the two apertures.

3. The seal assembly of claim 2, wherein the second end of the stainless steel wire is inserted in an opening that extends through a front cover and a base of the utility meter enclosure.

4. The seal assembly of claim 2, wherein the second end of the stainless steel wire is inserted in an opening that extends through a screw that secures a front cover of the utility meter enclosure with a base of the utility meter enclosure.

5. The seal assembly of claim 2, wherein the second end of the stainless steel wire is inserted into the two body openings of the female component and is retained by the V-shaped groove of the male component.

6. The seal assembly of claim 5, wherein the V-shaped groove sandwiches the stainless steel wire against a surface of the cavity of the female component.

7. The seal assembly of claim 1, wherein the male component is received in the cavity of the female component and the stainless steel wire is arranged within the male component and the female component and with respect to a front cover and a base of the utility meter enclosure such that the front cover cannot be separated from the base without breaking at least one of: the female component, the male component and the stainless steel wire.

8. A tamper system for a utility meter enclosure comprising:

a front cover joined with a base of the utility meter enclosure;

a female component comprising a cavity and two body openings;

a male component received within the cavity of the female component, the male component comprising: a plurality of anchors, two apertures, a top side, a bottom side, a U-shaped groove extending between the top side and the bottom side, and a V-shaped groove extending between the top side and the bottom side; and a stainless steel wire that extends through each of the two apertures of the male component, the U-shaped groove, at least a portion of the utility meter enclosure, the V-shaped groove, and each of the two body openings of the female component to secure the base to the front cover, wherein:

the top side of the male component comprises a first channel and a second channel, wherein the bottom side of the male component comprises a third channel and a fourth channel, wherein the U-shaped groove extends between an end of the first channel and an end of the third channel, and wherein the V-shaped groove extends between an end of the second channel and an end of the fourth channel, and wherein the two apertures extend between the first channel and the third channel;

when the male component is received in the cavity of the female component, a first body opening of the two body openings aligns with the second channel of the male component and a second body opening of the two body openings aligns with the fourth channel of the male component; and the female component further comprises two U-shaped openings, and wherein the stainless steel wire is positioned within the two U-shaped openings when the male component is press fit into the female component.

9. The tamper system of claim 8, wherein the base cannot be separated from the front cover without breaking at least one of: the female component, the male component and the stainless steel wire.

10. The tamper system of claim 8, wherein the stainless steel wire is arranged so that it extends along the first channel of the top side of the male component, the second channel of the top side of the male component, and the fourth channel of the male component.

11. The tamper system of claim 8, wherein at least a portion of the utility meter enclosure comprises an opening that extends through the front cover and the base of the utility meter enclosure.

12. The tamper system of claim 8, wherein at least a portion of the utility meter enclosure comprises an opening that extends through a screw that secures the front cover and the base of the utility meter enclosure.

13. A method for assembling the seal assembly of claim 1, the method comprising:

bending the stainless steel wire to form a bend between a first end and a second end of the stainless steel wire;

inserting the first end of the stainless steel wire through a first aperture of the two apertures so that the first end of the stainless steel wire extends from the top side of the male component toward the bottom side of the male component;

inserting the second end of the stainless steel wire through a second aperture of the two apertures so that the second end of the stainless steel wire extends from the top side of the male component toward the bottom side of the male component and so that the bend is adjacent the first channel of the male component;

bending the second end of the stainless steel wire and wrapping the second end of the stainless steel wire in the U-shaped groove so the stainless steel wire transitions from the bottom side to the top side of the male component and so that the stainless steel wire extends along the first channel and overlays the bend of the stainless steel wire; and inserting the second end of the stainless steel wire through the first aperture toward the bottom side of the male component.

14. The method of claim 13, further comprising inserting the second end of the stainless steel wire through an opening that extends between a front cover of the utility meter enclosure joined with a base of the utility meter enclosure.

15. The method of claim 13, further comprising inserting the second end of the stainless steel wire through an opening of a screw that joins a front cover of the utility meter enclosure with a base of the utility meter enclosure.

16. The method of claim 14, further comprising inserting the second end of the stainless steel wire through the first and second body openings of the female component.

17. The method of claim 16, further comprising inserting the male component into the cavity of the female component such that the V-shaped groove of the male component sandwiches a portion of the stainless steel wire against the cavity of the female component.

18. The method of claim 17, wherein inserting the male component into the cavity of the female component comprises positioning a portion of the stainless steel wire into a first of two U-shaped openings of the female component.

19. The method of claim 18, further comprising positioning the second end of the stainless steel wire within a second of the two U-shaped openings of the female component.

* * * * *